United States Patent [19]

Barathon et al.

[11] Patent Number: 4,494,361

[45] Date of Patent: Jan. 22, 1985

[54] PACKAGING OF DRINKING STRAWS

[75] Inventors: Jean-Claude Barathon; Fernand Moiny, both of Donzy; Christian Soyez, Cosne; Gérard Soyez, Celle S. Loire, all of France

[73] Assignee: Soyez FR. S.A., France

[21] Appl. No.: 290,003

[22] Filed: Aug. 4, 1981

[30] Foreign Application Priority Data

Aug. 6, 1980 [FR] France ..... 80 17371

[51] Int. Cl.[3] ..... B65B 47/04

[52] U.S. Cl. ..... 53/553; 53/559

[58] Field of Search ..... 53/553–555, 53/450–451, 546, 548, 550–552, 559–660

[56] References Cited

U.S. PATENT DOCUMENTS

| | | | |
|---|---|---|---|
| 1,481,866 | 1/1924 | Heist | 53/553 X |
| 3,557,517 | 1/1971 | Limmer | 53/553 X |
| 3,686,820 | 8/1972 | Zenger | 53/555 X |
| 4,384,441 | 5/1983 | Maruyama | 53/553 |

*Primary Examiner*—A. J. Heinz

*Attorney, Agent, or Firm*—Thomas J. Greer, Jr.

[57] ABSTRACT

Apparatus for packaging of drinking straws. A cylinder having notches extending longitudinally thereof is positioned at the lower end of a hopper for the straws. The hopper has a supply conduit terminating in an outlet closely overlying the surface of the cylinder. The straws pass into the supply conduit in parallel horizontal positions to define an endless column. A feed mechanism compresses the straws within the supply conduit so that individual straws are forcefully engaged with the notches in the cylinder. A first web is fed onto the periphery of the cylinder in overlying relation to the notches and when a notch, covered by the first web, moves into alignment with the outlet of the supply conduit, a lowermost straw is forced from the supply conduit into the notch while deforming the web to the general configuration of the notch. A second web is fed into overlying relation with respect to the cylinder and the first web to hold the straws depressed within the notches until edges of the webs are bonded together.

11 Claims, 6 Drawing Figures

PACKAGING OF DRINKING STRAWS

The present invention relates to an apparatus for the manufacture of a sheet constituted by two strips enclosing a series of drinking straws therebetween.

The apparatus of the invention is designed for using two flat strips as the initial material, in contrast to other apparatus which use one flat strip and one strip in which cavities for receiving the tubes are pre-formed.

Apparatus of this type is known for locating objects from place to place between two flat strips and then for welding these two strips together thus enclosing these objects therebetween, as described for example in U.S. Pat. No. 3,686,820, but such apparatus has a discontinuous operation.

The object of the present invention is to provide an apparatus which can operate continuously for wrapping tubes constituting drinking straws, making it possible to wrap 400 to 600 tubes per minute.

An apparatus according to the invention will now be described with reference to the accompanying drawings in which.

Figure 1:
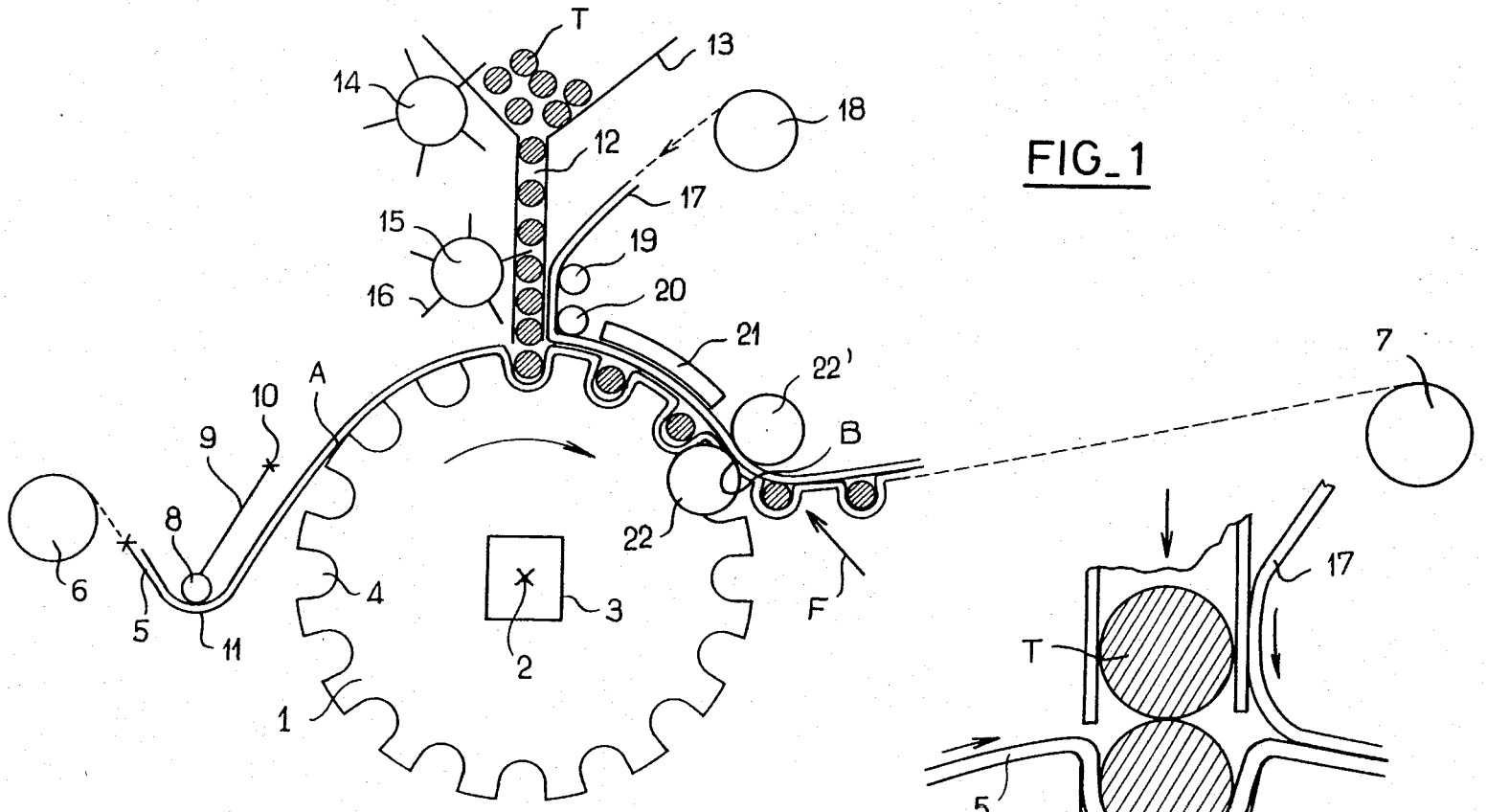
FIG. 1 is a general diagram of the apparatus.

The apparatus of the invention comprises an endless member, for example a cylinder 1, which rotates continuously about its axis 2 under the action of driving means 3. Cut in the surface of the cylinder are recesses 4 which extend parallel to the axis of the cylinder, which are uniformly distributed over the periphery of the cylinder and which are each able to receive a tube. The depth of the recesses corresponds substantially to the diameter of a tube. For example, for tubes having a diameter of 3.3 mm, the cross section of the recesses is in the shape of a circle having a diameter of 4 mm limited to a depth of 3.3 mm. The length of a recess is less than that of a tube so that the tube projects from the recess at each end.

A first strip 5 of weldable, flexible plastics material, for example of polypropylene, unwinds from a reel 6 and travels to a winding reel 7 thus coming into contact with the cylindrical surface of the cylinder over a sector AB of the circle described by the rotating cylinder. This strip is less thick than when using a preformed strip.

Just sufficient tension is imparted to the strip in order to keep the latter aligned over the unwinding path, i.e. a sufficient tension to prevent the strip from moving away from this path either to the right or to the left. This tension is produced for example by a follower 8 mounted at the free end of an arm 9 whereof the other end pivots freely about a pivot 10. The follower rests in a bend 11 of the strip 5 and its weight is chosen so as to create the desired tension.

A vertical conduit 12, whereof the cross-section, as regards the width and length, has substantially the dimensions of a tube as regards diameter and length, is connected at its upper end to a hopper 13 and opens at its lower end into the immediate vicinity of the surface of the cylinder, in the sector AB. The tubes T present in the hopper 13 drop into the conduit, under the action of a rotary brush 14 and in the conduit permanently form a vertical column of horizontal tubes, parallel to the recesses.

A tube T is permanently present at the outlet of the distributor, it drops into the first recess which passes below this outlet pushing the strip 5 down below it, as shown more clearly in FIG. 2 and it is immediately replaced by the next tube in the column. The tube is assisted in dropping into the recess by a rotary brush 15, whereof the blades 16 exert a downwardly direction pushing action onto the lower tube or tubes in the distributor.

It will be understood that the strip 5 must not be too taut, since this tension would prevent the tube from entering the recess.

Figure 2:
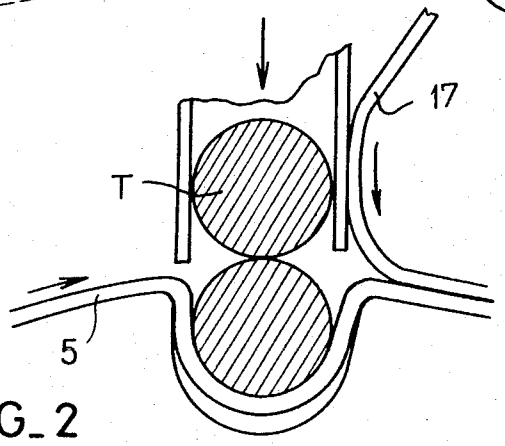
FIG. 2 is an enlarged detailed view of the apparatus in the region of the outlet end of the tube distributor.

A second flexible strip of plastics material 17 coming from a reel 18 is guided by suitable means represented by two rollers 19,20 in order to be placed on top of the strip 5 immediately after the strip 5 has past the outlet of the distributor 12 (FIGS. 1 and 2). The two strips are then kept pressed one in contact with the other by virtue of a guide 21 which extends over a portion of the sector AB as far as an apparatus which will fix these strips one to the other.

Figure 3:
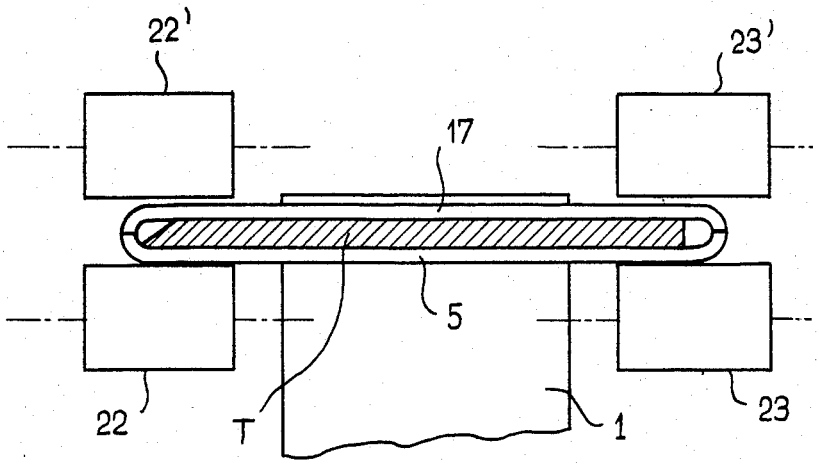
FIG. 3 is a view in direction F of an apparatus used for welding the two strips to each other.
Figure 4:
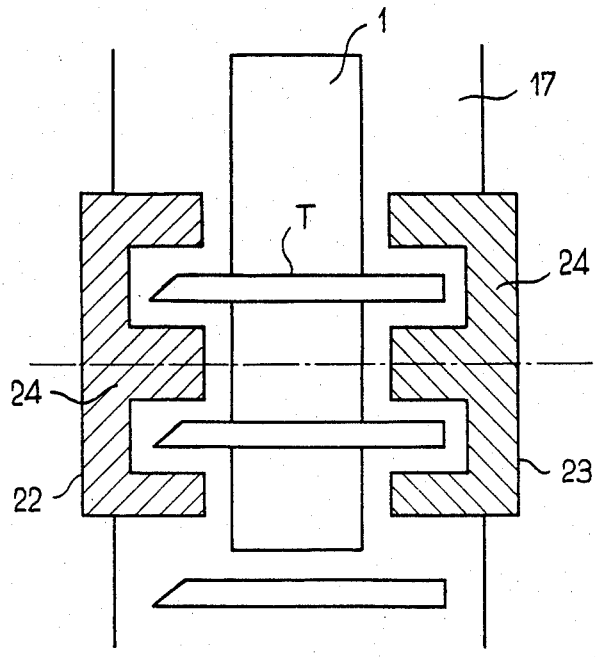
FIG. 4 is an exploded view of a wheel of the apparatus of FIG. 3.
Figure 6:
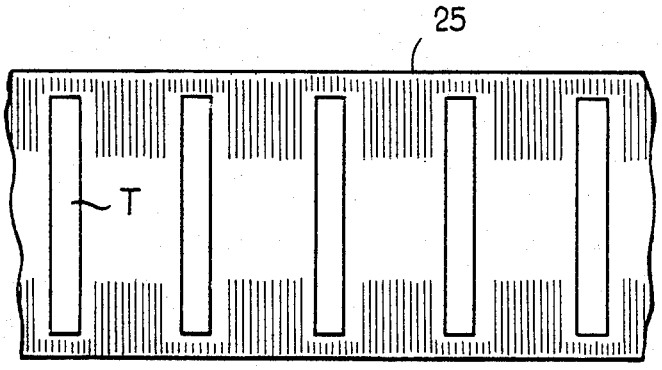
FIG. 6 is a plan view of this product.

This apparatus comprises two pairs of heated wheels 22,22' and 23,23'. The two wheels of each pair define a gap therebetween, through which passes one edge of the sheet constituted by the two strips (FIG. 3). The two pairs are arranged respectively on the right and left of the cylinder 1 in the vicinity of the outlet B of the sector AB. Each wheel permanently touches one strip by a toothed heated track. In FIG. 4, which is an exploded view of the wheels 22 and 23, the heated track is illustrated by the shading 24. The rotation of the wheels is synchronised with the rotation of the cylinder so that the tubes are located between the heated toothing. The two strips are thus welded together in regions 25 which surround the ends of the tubes (FIG. 6).

By way of addition, it is the function of the welding wheels to entrain the strips for the purpose of their conveyance.

Figure 5:
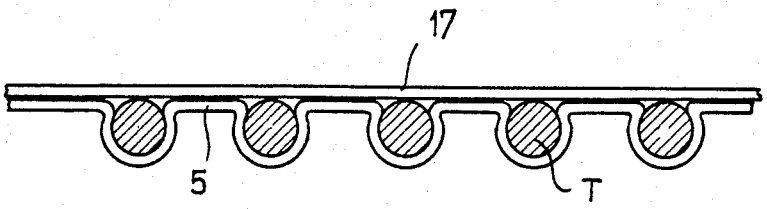
FIG. 5 is a section through the depth of the product obtained.

After welding, the complex sheet obtained is constituted by two interconnected strips 5, 17 enclosing the tubes T therebetween (FIG. 5). This sheet leaves the cylinder at the point B and possibly undergoes various operations (additional welding, perforating, marking . . . ) before being wound on the reel 7. These additional operations advantageously comprise transverse welding of the strips between the tubes by means of a transverse wheel having a toothed heated track which extends over the width of the strip.

The invention is not limited to this embodiment. In particular, the tubes may be supplied to the recesses horizontally instead of being supplied to them vertically. A horizontal supply device is described for example in French Pat. No. 70 12395.

EXAMPLE

With a cylinder having a diameter of 954.6 mm comprising 200 recesses and rotating at 2.5 rpm, it is possible to wrap 500 tubes per minute. The tubes have a diameter of 3.3 mm and the recesses have a cylindrical base with a diameter of 4 mm. The axes of the recesses are spaced apart by 11 mm. The outlet of the distributor is at a distance of 0.5 mm from the surface of the strip. The welding wheels rotate 10 times per minute and entrain the strips. The wheels mesh with a common synchronizing pinion. A common source of movement actuates the cylinder and the wheels with driving ratios of 1 and 4.

What is claimed is:

1. An apparatus for the manufacture of a sheet constituted by a first and second strip of flexible material enclosing a series of tubes therbetween, said tubes having ends and being in the form of lightweight hollow members, said apparatus comprising an endless member with a surface defining parallel recesses each capable of receiving a tube, said endless member having an axis of rotation, means for rotating the endless member continuously about said axis of rotation, means for bringing the first strip of flexible material into contact with said surface of the endless member over a sector of the path of the endless member, means for distributing the tubes including a supply conduit in which the tubes form a column of tubes, said column having a lower end which is parallel to the recesses, means for pushing said column of tubes through the conduit in the direction of said surface, and in which the supply conduit has an outlet which opens out in the immediate vicinity of the surface of the endless member at one point of said sector, so that the tube present at the outlet of the conduit and in contact with the first strip is forced into the recess of the endless member which passes below said outlet thus pushing the first strip into the recess and is immediately replaced by the next tube in the column, means for causing the second strip of flexible material to overlap the first strip downstream of said outlet in the direction of rotation of the endless member, and rotary heated wheels and a guide, said wheels permanently touch the two overlapping strips by toothed heated tracks, the rotation of the wheels being synchronized with that of the endless member so that the tubes are located between the heated teeth and the first and second strips are welded one to the other in regions which surround the ends of the tubes, the guide being located on a portion of said sector between the outlet of said supply conduit and the heated wheels and being employed to keep the two strips pressed one against the other between said outlet and said wheels.

2. An apparatus as claimed in claim 1, in which the strips are entrained by the heated wheels.

3. An apparatus as claimed in claim 1, in which each recess has a length less than that of a tube so that the tube projects from the recess at each end, and in which the heated wheels comprise two pairs, the wheels of each pair defining a gap therebetween through which passes one edge of the sheet constituted by the two strips, the two pairs being located respectively on the right and left of the endless member.

4. An apparatus as claimed in claim 1, in which the endless member is a cylinder.

5. An apparatus for the packaging of staws and like lightweight tubular members, said apparatus including a cylinder, means mounting said cylinder for rotation about an axis, drive means connected to said cylinder for continuously rotating said cylinder, said cylinder having a peripheral surface provided with uniformly spaced axially extending like notches, said notches being dispersed parallel to said axis and of a radial depth slightly greater than the diameter of the lightweight tubular members, a hopper for the tubular members radially spaced from said cylinder, a columnar supply conduit extending radially between said hopper and said cylinder, said supply conduit receiving a plurality of tubular members to form a column of tubular members in said conduit and having an outlet immediately above said cylinder for supplying the tubular members being positioned parallel to said axis and to said notches, a means for supplying a first deformable web to the surface of said cylinder in advance of said supply conduit and in overlying relation to those of said notches advancing toward said supply conduit, means for pushing at least a portion of said column of tubular members to forceably discharge a tubular member from the outlet to deform said web into an underlying one of said notches, means for supplying a second deformable web to the periphery of said cylinder in overlying relation to said first deformable web immediately downstream of said supply conduit for cooperation with said first deformable web and for holding said tubular members in said notches, and sealing means for sealing together edge portions of said webs axially beyond the ends of said tubular members and between the ends of said tubular members.

6. Apparatus according to claim 5 wherein said sealng means includes a pair of cooperating wheels positioned adjacent each end of said cylinder.

7. Apparatus according to claim 6 including a guide disposed radially of said cylinder and positioned between said supply conduit and said sealing means, said guide for holding said webs together.

8. Apparatus according to claim 5 wherein said notches open through ends of said cylinder, and wherein said supply conduit is of a dimension in the direction of said axis of cylinder rotation greater than the length of said cylinder with said supply conduit outlet being centered axially relative to said cylinder to place the tubular members in said notches with each end of a tubular member projecting beyond ends of said cylinder, and said sealing means includes a pair of cooperating wheels positioned axially beyond said cylinder at each end of said cylinder.

9. Apparatus according to claim 5 wherein said means for forceably discharging the tubular members from said supply conduit includes rotary brush means positioned alongside said supply conduit for engaging the tubular members in said supply conduit.

10. Apparatus according to claim 9 including means cooperating with said hopper to forceably feed tubular members from said hopper into said supply conduit.

11. Apparatus according to claim 5 including guide means for said second web to guide said second web adjacent one side of said supply conduit.

* * * * *